United States Patent [19]

Belokin, Jr.

[11] 4,403,702

[45] Sep. 13, 1983

[54] VARIABLE DISPLAY MERCHANDISING RACK

[76] Inventor: Paul Belokin, Jr., Rte. 4, Hayward, Wis. 54843

[21] Appl. No.: 188,334

[22] Filed: Sep. 18, 1980

[51] Int. Cl.[3] ..... A47F 5/04

[52] U.S. Cl. ..... 211/189; 206/44 R; 211/60 R; 211/194

[58] Field of Search ..... 211/189, 194, 131, 60 R, 211/133; 248/158, 346; 206/44 R; 220/69, 90.4

[56] References Cited

U.S. PATENT DOCUMENTS

| | | | |
|---|---|---|---|
| D. 249,273 | 9/1978 | Day | D19/85 X |
| 1,645,399 | 10/1927 | Pontikis | 211/133 |
| 2,951,593 | 9/1960 | Lake | 108/139 |
| 3,089,605 | 5/1963 | Buonauro | 220/69 X |
| 3,295,671 | 1/1967 | Wuensch et al. | 211/74 X |
| 3,482,731 | 12/1969 | Douty | 220/69 |
| 3,526,335 | 9/1970 | Swett et al. | 220/69 |
| 3,695,458 | 10/1972 | Nagel | 211/194 |
| 3,929,230 | 12/1975 | Luthi | 211/194 |
| 4,193,351 | 3/1980 | Belokin | 108/59 |

*Primary Examiner*—Ramon S. Britts
*Assistant Examiner*—Robert W. Gibson, Jr.
*Attorney, Agent, or Firm*—James E. Nilles

[57] ABSTRACT

A knock-down display rack assembly for displaying articles at a point of purchase, including a base having a plurality of recesses, a plurality of center posts, a plurality of containers each having an open upper end and also having a center post receiving member having upper and lower ends for detachable engagement of the ends of the center posts. The containers may thereby be stacked, along with the posts, vertically on one another, the lower end of the center posts receiving member also being insertable in the recesses in the base so as to provide a plurality of stacks of containers on a single base.

1 Claim, 5 Drawing Figures

VARIABLE DISPLAY MERCHANDISING RACK

BACKGROUND OF THE INVENTION

1. Field of Use

This invention relates generally to display racks or shelving arrangements for easy access to shoppers of articles contained therein. In particular, it relates to a display rack having a plurality of containers capable of being arranged in many horizontal and vertically stacked configurations.

2. Description of the Prior Art

Various display racks or shelving arrangements have been proposed for completely displaying products to be sold and which permit easy access to the products by the shopper. One example of such a display rack is shown in U.S. Pat. No. 4,193,351, issued to the present applicant, Belokin, on Mar. 18, 1980, and which provides a center post which is made up of segments telescopingly engaged together, the telescoping post extending upwardly from a single hole in a base. Another example of that general type of display is shown in U.S. Pat. No. 3,295,671, issued to Wuensch on Jan. 3, 1967. The British Patent No. 10,277, issued to Milne in 1906, shows a plurality of vertical posts on a single base and in which the articles themselves form the supporting means between the intervening shelves, an arrangement similar to that of U.S. Pat. No. 2,951,593, issued to Lake on Sept. 6, 1960. The German Patent No. 2,321,999, issued to Delbrouck on Nov. 21, 1974, shows a rack with vertically stacked containers supporting each other. Some of these prior art references have certain deficiencies which render them somewhat unsuitable for point-of-purchase display of some articles.

The Wuensch and Milne patents disclose racks with vertically adjacent shelves and in which the articles displayed provide support for the tray immediately above. Such display racks are suitable for articles which are sufficiently rigid to support a tray and of a uniform height, and for trays where only one kind of merchandise will be sold. However, if the displayed articles are not rigid, are of varying heights, or if it is desired to sell various kinds of articles on different shelves of the same display rack and permit simultaneous access to any of the shelves, the Wuensch and Milne racks are unsuitable.

The Lake patent discloses a rack having vertically spaced-apart platforms or shelves on a vertical center post and which does not rely on the articles being displayed for support of those shelves. A plurality of collars and pins, the latter horizontally disposed through vertically-spaced transverse openings in the center post, provide the support means for the shelves. The collars and pins are an unnecessarily complicated shelf support means with numerous parts. Further, the rack of the Lake patent provides no arrangement other than one in which the shelves are vertically stacked upon one another.

The Delbrouck patented device provides containers with an open upper end, but the upper end has a flange for accepting the bottom of the container immediately thereabove. In accepting that higher container's bottom, the upper end of the receiving container is closed off, there being no access provided to the contents of any container but the uppermost.

SUMMARY OF THE PRESENT INVENTION

The present invention provides a knock-down type display rack assembly for displaying articles at a point of purchase, and which includes a base having a plurality of upwardly facing recesses, a plurality of center posts, a plurality of containers each having an open upper end and also having a center post receiving member having upper and lower ends and for detachable engagement with the ends of the center posts. The containers may be stacked vertically on one another utilizing the posts, and the containers may be inserted in the recesses of the base by the lower end of their center post receiving members so as to provide a plurality of stacks of containers on a single base.

The articles contained within the rack's containers are easily accessible, there being space between the upper open end and the nearest lower end of vertically adjacent containers. The present rack assembly is quickly and easily assembled as there are no collars or pins necessary to retain the containers on their center posts in a vertically spaced apart relationship, the assembly is self-supporting, and the articles displayed thereon do not comprise a part of the support structure, and as a result, non-rigid articles or articles of various sizes may be displayed on each of the vertically adjacent racks, and articles on each of the racks are simultaneously accessible. The assembly of the present invention has a base with a plurality of upwardly facing recesses, permitting horizontal arrangement of the containers. The rack assembly is readily changed from one configuration to another by pulling upwardly on the containers and center posts to disassemble them and then reassembling the rack as desired.

These and other objects of the present invention will appear hereinafter as this disclosure progresses, reference being had to the accompanying drawings.

DESCRIPTION OF A PREFERRED EMBODIMENT

Figure 1:
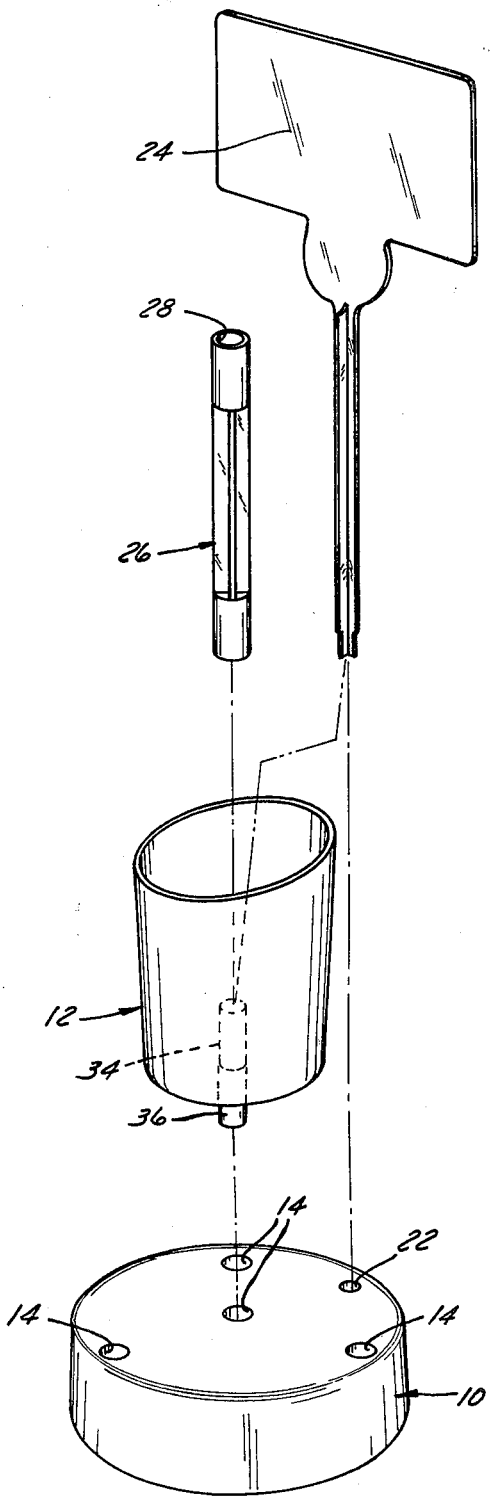
FIG. 1 is an exploded perspective view of a display rack assembly made in accordance with the present invention.

The display rack assembly provided by the present invention is preferably made of lightweight yet rigid and strong plastic material such as a polycarbonate or polyethylene, and the components to be described hereinbelow, the center post, container and base, may be inexpensively fabricated by injection molding in a process well-known in the art. Ideally, the containers will be transparent so as to provide visibility of the contents therein when the display rack assembly is being viewed from its side.

The display rack assembly includes means for preventing tipping thereof during normal use at the point of purchase. This means may comprise a base 10 of circular configuration and of sufficient diameter to provide support against tipping or overturning, as for example, when a customer reaches into a container 12 of the display rack assembly to retrieve an article contained therein. A plurality of upwardly-facing recesses 14 are provided in the base, each of the recesses being identical so as to provide a snug fit for the recess-engaging portion of the containers, as explained hereinbelow.

Each of the recesses is comprised of two vertical, cylindrical apertures or sections, the upper section 16 being of a slightly wider diameter than the lower section 18. The lower section's reduced diameter defines a smaller counterbore within each recess and a horizontally-disposed flange 20 is formed by the counterbore at its junction with the upper section. In addition, a sign aperture 22 with a downwardly tapered bore may be molded into the base, permitting insertion therein of removable sign means 24 for displaying an advertiser's logo, trademark, or other desired script.

Means are further provided for supporting each of the containers stacked vertically above the base-supported containers. These means comprise a plurality of center posts 26, each having an elongated, axially outwardly opening socket 28 at each end of a cross-member 30. For example, each socket may comprise a cylindrical shell with an outwardly-facing open end and whose inwardly-facing end is attached to the cross member. The inner portion of each socket is of a diameter equal to the diameter of the upper section 16 of recesses 14, the sockets also providing a snug fit for the recess-engaging portions of the containers. The cross-member and sockets are of a combined length to ensure that sufficient space is provided between the open upper end of a container and the lower end of the container immediately above to enable customers to reach into any of the containers and remove articles therein.

Figure 5:
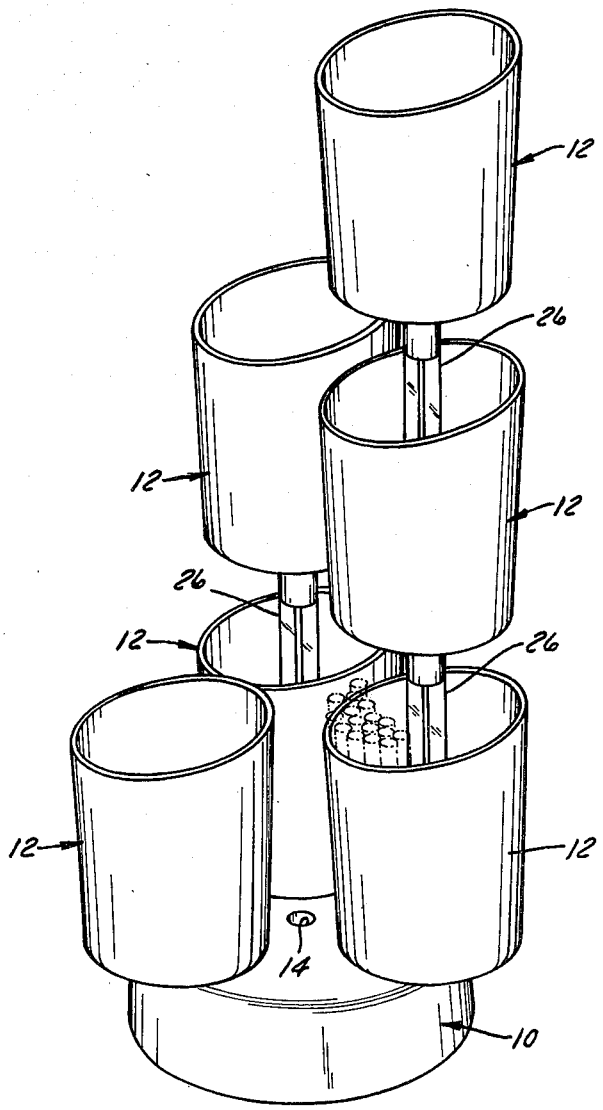
FIG. 5 is a perspective view of another alternate configuration of the display rack assembly, and showing articles contained therein.

Means are further provided for containing articles on the rack assembly, which may comprise a plurality of one-piece containers 12. The containers are, as stated above, suitably constructed of a transparent material to ensure that articles contained therein are visible when the display rack assembly is viewed from its side. They may be substantially cup-shaped, with a bottom 38 and a side wall 40 and an open top. The container is preferably inclined across its open upper end (FIG. 2) to present a lower edge, thereby providing good accessibility to and visibility of the articles therein. As is shown in FIG. 5, the display rack can be assembled so as to have each of the containers in the three vertical stacks of containers with its lower front edge facing a customer to permit facile access to and visibility of the articles therein. The inclined upper end provides for an automatic front loading action of long, thin articles such as those shown in FIG. 5. As such articles are removed by each customer, those remaining in the container have a tendency to slide on the inclined edge from a higher to the lowest point.

Container 12 is also provided with an integrally formed interengageable member in its bottom. This member comprises a center post receiving member 32 having an upper 34 and a lower end 36, the upper and lower ends being separated by and extending upwardly and downwardly, respectively, from the bottom of the container. The upper and lower ends are cylindrical in shape in this embodiment, and of an outer diameter only slightly smaller than those of the upper section 16 of the recesses and the inner portions of each socket 28 of center post 26, so that the lower end may be snugly inserted into and vertically supported by either the recesses 14 or the sockets 28, respectively, depending on whether the container is mounted within the base 10 or is vertically stacked upon another container 12 and supported by a center post 26. In this manner, the containers 12 are held upon the base 10 with their radial axes vertically disposed.

Figure 2:
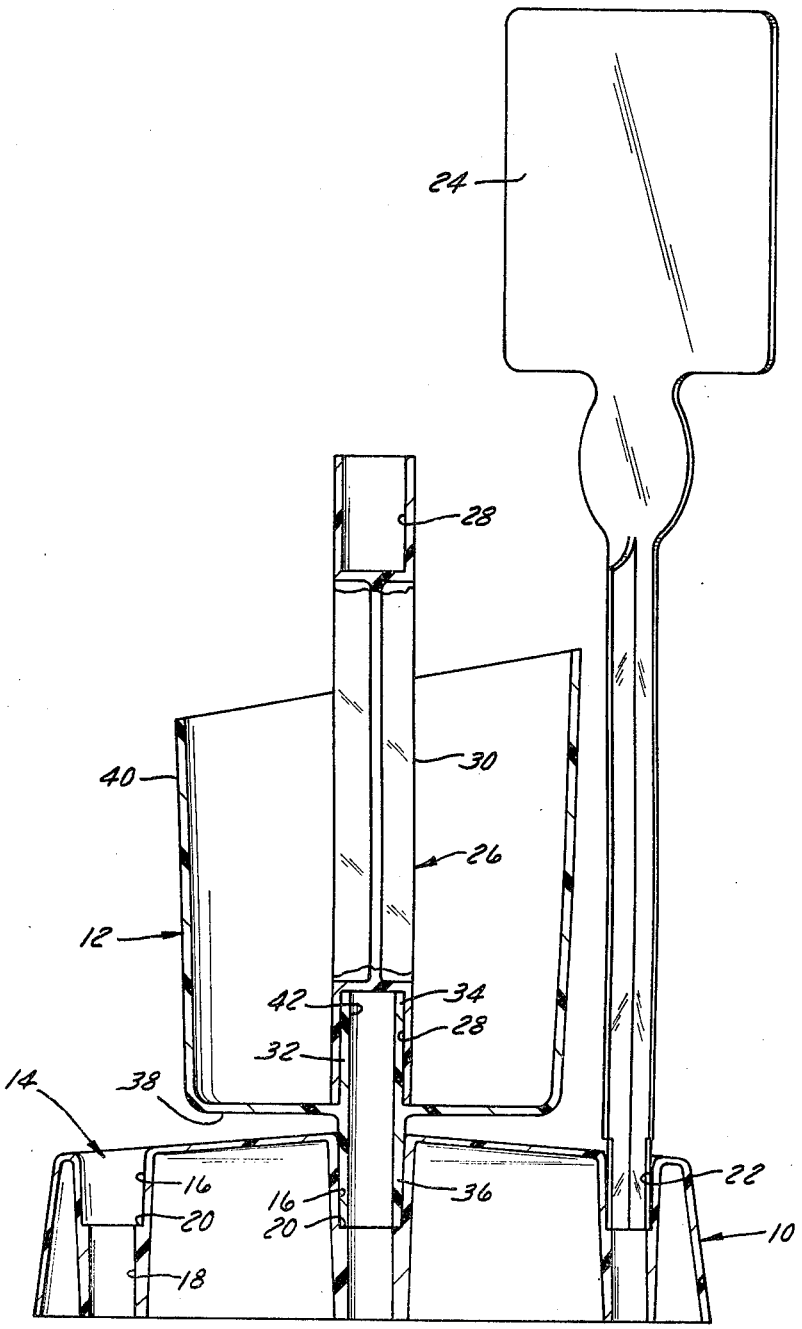
FIG. 2 is a vertical, cross sectional view of the FIG. 1 assembly, but shown assembled and on an enlarged scale.

The lower end 36 of the center post receiving member is also of a length greater than the length of the upper section 16 of recess 14, to prevent the container's bottom wall from contacting the base. The lower end 36 is inserted into a recess 14, and moves downwardly in that recess until it reaches the counterbore 20 of recess 14 (FIG. 2). Upon reaching the counterbore, the lower end 36 is prevented from further downward movement and rests upon horizontally-disposed flange 20.

The upper end 34 of the center post receiving member 32 has an outer diameter identical to that of the lower end 36, but is socket-like and similar to socket 28, but having smaller inner and outer diameters. The socket-like upper end 34 has an upwardly-facing opening 42 with an inner diameter approximately equal to that of sign aperture 22. Sign means 24 may thus be inserted into the opening of the upper end 34 of any center post receiving member which is unobstructed by another vertically-adjacent container or center post, as may be seen in FIG. 4.

Figure 3:
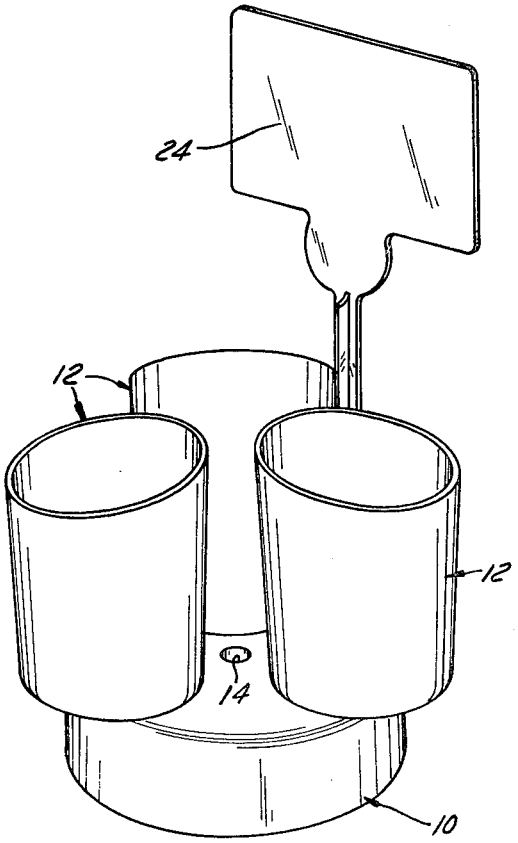
FIG. 3 is a perspective view of the present display rack assembly on the scale of FIG. 1 and in a horizontal, circular configuration.
Figure 4:
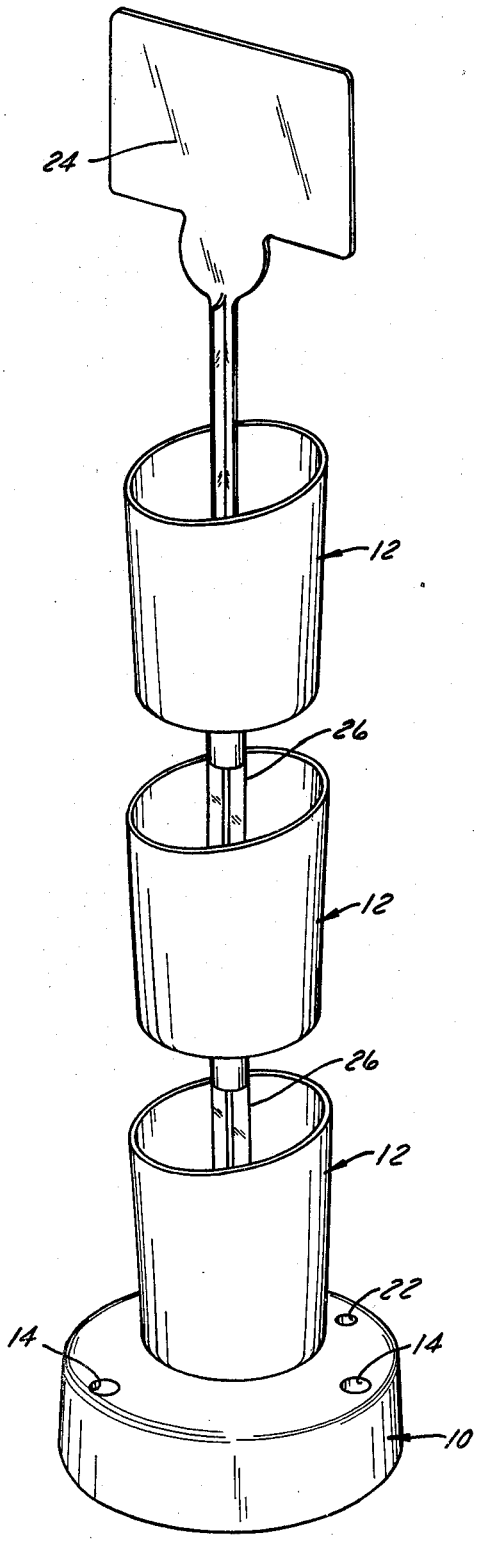
FIG. 4 is a perspective view of an alternate configuration of the display rack assembly.

The containers may be vertically stacked upon one another using center posts 26. One or more containers are placed on the base 10 with the lower end 36 of each center post receiving member engaging a recess 14 in the base. The center post 26 is then slipped over the upper end 34 of center post receiving member 32, the center post 26 and upper end 34 being telescopingly engageable, giving the assembly the appearance shown in FIG. 2. The upper-most socket 28 of center post 26 is now ready to telescopingly receive the lower end 36 of a center post receiving member and thereby permit vertical stacking of containers. Such alternate use of containers and center posts may be continued to permit stacking of any number of vertically adjacent containers. Only a few of the many possible configurations are shown in FIGS. 3, 4, and 5.

Recapitulation

The containers of the present assembly can be used for display of rigid or non-rigid articles of various sizes, and the open upper ends of the containers are unobstructed by containers vertically thereabove to permit display of and simultaneous access to the articles in any of the containers. The tops of the containers are inclined downwardly to thereby present a lower edge for facilitating customer access to articles contained therein. The center posts provide both vertical spacing between adjacent containers and support for those containers on the posts, eliminating the need for auxiliary support means such as collars and horizontally-disposed pins.

What I claim is:

1. A knock-down display rack assembly for displaying articles at a point a purchase and which includes a base having a plurality of center posts, each of said center posts comprising a pair of elongated and axially outwardly-opening sockets, said center post further comprising a cross-member, the ends of said cross-member being connected to said sockets, a plurality of containers each having an inclined open upper end and also having a bottom, said inclined open upper end presenting a lower edge for good accessibility of said articles displayed therein, said container further having an integrally formed center post receiving member in its bottom with an upper and lower end and for detachable telescoping engagement with said sockets of said center posts whereby said containers can be stacked vertically on one another, said lower end of said center post receiving member being insertable in said recesses in said base so as to provide a plurality of stacks of containers on a single base, said center posts being quickly and easily removable from said upper ends of said center post receiving members by simple upward movement of said center posts, said center posts further being of a length sufficient to permit simultaneous customer access to said open ends of any of said vertically stacked containers, and said containers being transparent and being molded in one piece and of a plastic material.

* * * * *